US005409195A

United States Patent [19]

Strickland et al.

[11] Patent Number: 5,409,195

[45] Date of Patent: Apr. 25, 1995

[54] SAFETY CABLE RESTRAINT SYSTEM FOR RAILROAD BRIDGES

[75] Inventors: Michael R. Strickland, Richmond Hill; Kevin R. MacDonald, Toronto; Joseph L. To, Mississauga, all of Canada

[73] Assignee: Smmart Equipment Inc., Mississauga, Canada

[21] Appl. No.: 1,460

[22] Filed: Jan. 7, 1993

[51] Int. Cl.[6] ..... E04H 17/00

[52] U.S. Cl. ..... 256/1; 256/13.1; 256/DIG. 6; 248/228; 182/3

[58] Field of Search ..... 256/1, 19, 32, 73, 50, 256/66, 65, 47, 13.1, 94, DIG. 6; 248/228; 182/3, 45

[56] References Cited

U.S. PATENT DOCUMENTS

| | | | |
|---|---|---|---|
| Re. 22,060 | 4/1942 | Hayden et al. | 256/13.1 |
| 821,841 | 5/1906 | Tower | 248/228 X |
| 835,414 | 11/1906 | Goldie | 248/228 X |
| 3,210,051 | 10/1965 | Case | 256/13.1 |
| 4,037,824 | 7/1977 | Whitmer | 182/3 X |
| 5,029,670 | 7/1991 | Whitmer | 182/3 X |
| 5,104,079 | 4/1992 | Hardtke | 248/228 |

FOREIGN PATENT DOCUMENTS

| | | | |
|---|---|---|---|
| 2815533 | 10/1979 | Germany | 248/228 |
| 3023489 | 1/1982 | Germany . | |
| 1141172 | 2/1985 | U.S.S.R. | 182/3 |
| 1504153 | 8/1989 | U.S.S.R. | 256/1 |

*Primary Examiner*—Randolph A. Reese
*Assistant Examiner*—Harry C. Kim
*Attorney, Agent, or Firm*—Leydig, Voit & Mayer, Ltd.

[57] ABSTRACT

A safety cable restraint system for easy attachment to the rail of a railroad track crossing a bridge including a restraint cable anchored at each end to a leg clampable to the rail so as to hold the cable ends outboard of the rail and a plurality of intermediate cable supports secured to legs clampable to the rail for holding the restraint cable above and outboard of the rail. The legs are preferably adjustably clamped to the rail to accommodate rails of different sizes and the legs are adjustably spaced to accommodate different sizes and spacings of rail ties.

9 Claims, 3 Drawing Sheets

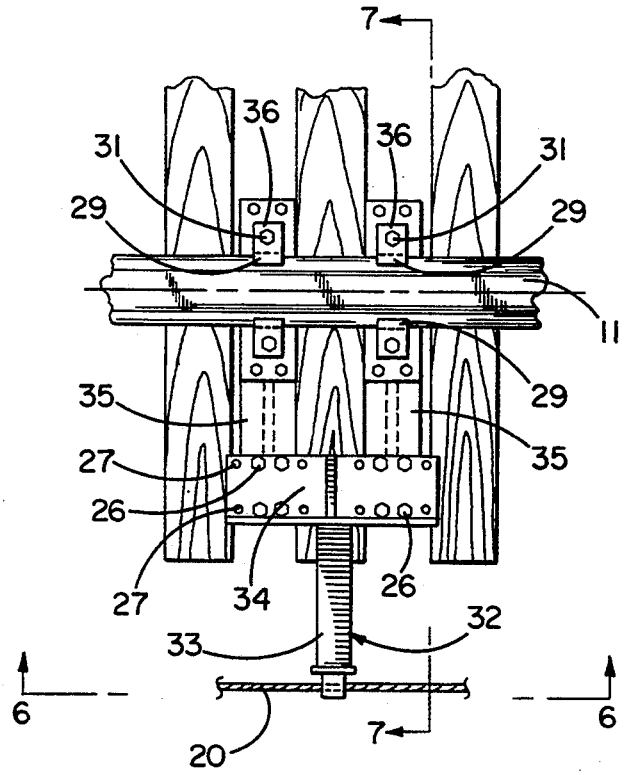
FIG. 5
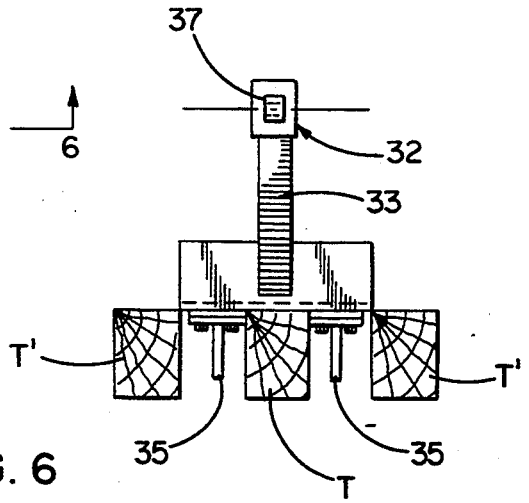
FIG. 6
FIG. 7
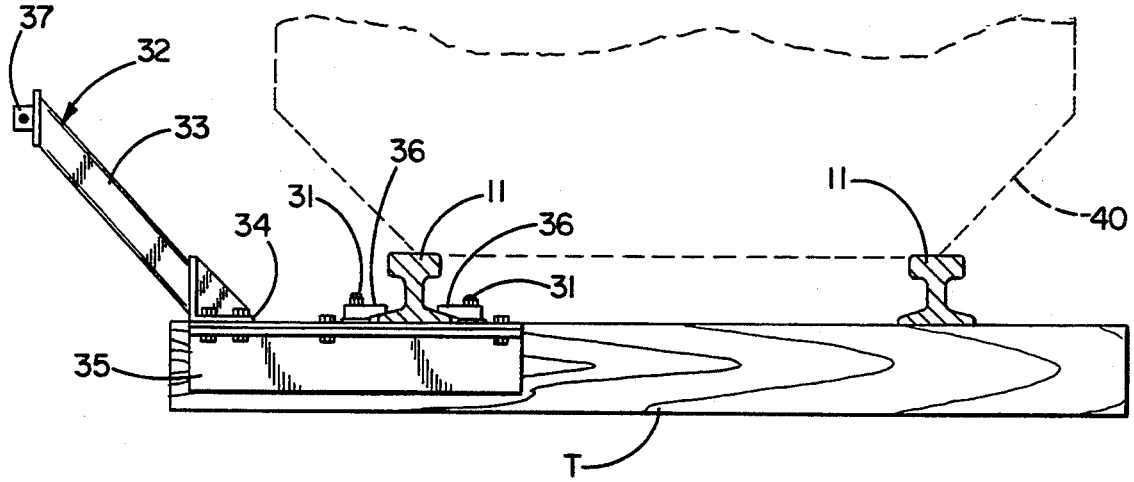

SAFETY CABLE RESTRAINT SYSTEM FOR RAILROAD BRIDGES

FIELD OF THE INVENTION

The present invention relates generally to railroad personnel safety devices and more particularly concerns a cable restraint system for use with a safety line or fall arrest system for railroad personnel working on railroad bridges and the like.

BACKGROUND OF THE INVENTION

When railroad tracks cross rivers, ravines and the like, it is generally necessary to support the rails of the track on bridges or tressels. Frequently these bridges and tressels have been constructed with open sides outboard of the rails. In other words, they do not have sidewalls or guard rails along the edges of the bridge outside of the rails.

Rail bridges and tressels, however, do require periodic inspection and maintenance of the roadbed including the track, ties, ballast and/or other supporting material. Accordingly, railroad personnel must cross the bridge or tressel, often on foot, to perform their necessary inspection and maintenance functions and work. The absence of sidewalls and/or guardrails along the edges of the bridges outboard of the rails presents potentially unsafe and hazardous situations for railroad personnel who must walk along the tracks in connection with their inspection and maintenance duties.

OBJECTS AND SUMMARY OF THE INVENTION

It is the primary aim of the present invention to provide a fixed cable restraint system that may be quickly, conveniently and securely attached along the rails of railroad track extending over rail bridges, tressels and the like and to which a safety line or personnel fall arrest system and safety harness may be attached.

A more detailed object is to provide such a cable restraint system that is relatively inexpensive to make and that can be directly attached to railroad track rails of different sizes.

It is a related object to provide a cable restraint system that includes cable anchor and support legs that are adjustably positionable in order to fit around and between rail ties of different sizes and spacings.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 5 is an enlarged, fragmentary plan view of one of the intermediate supports for the cable restraint system, substantially as seen along line 5—5 in FIG. 1;

FIG. 6 is a side elevation of the intermediate support of FIG. 5, substantially as seen along line 6—6; and FIG. 7 is an end view, partially in section, of the intermediate support of FIG. 5, substantially as seen along line 7—7 in FIG. 5.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figures 1A, 1B:
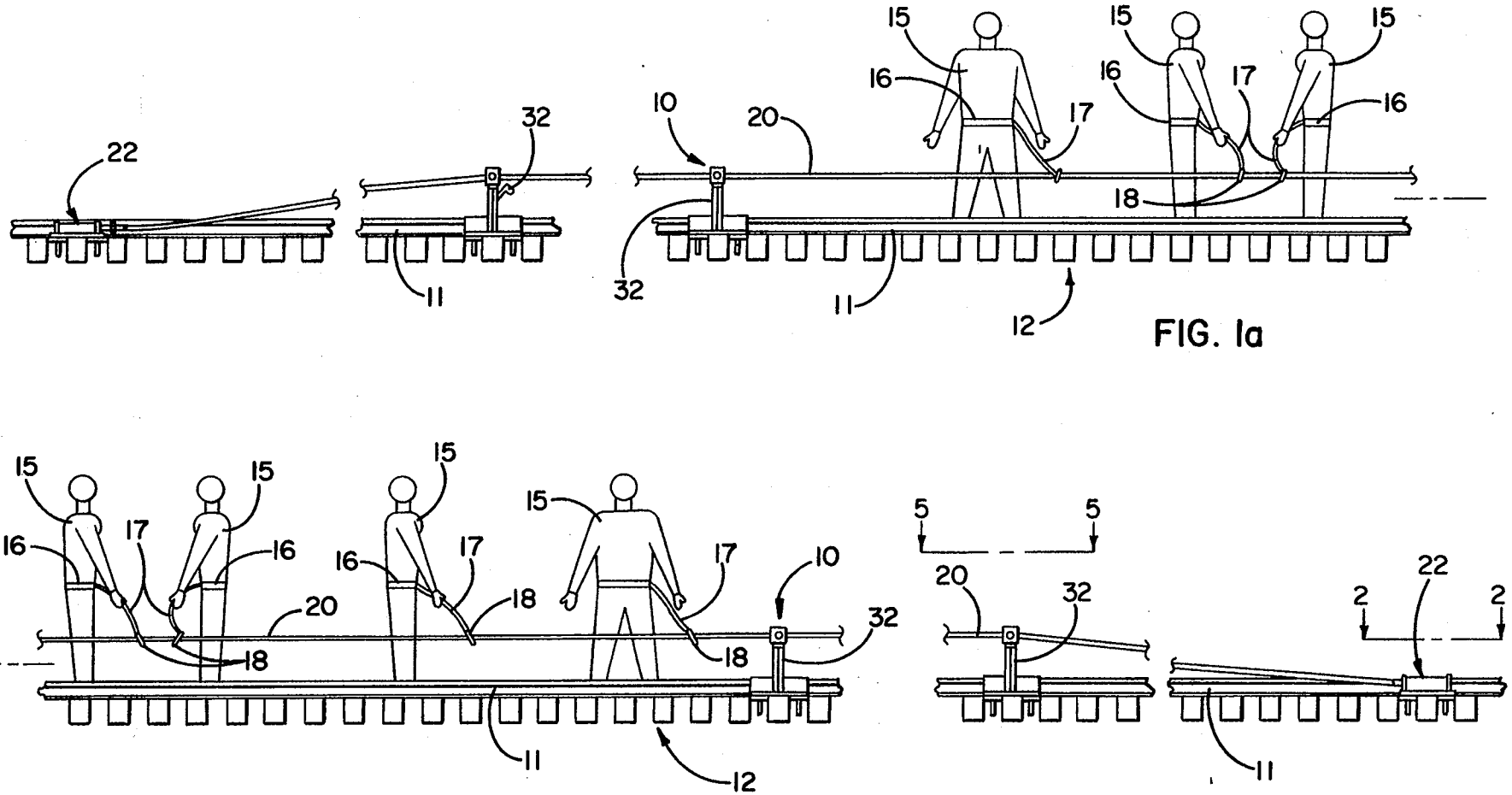
FIGS. 1*a* and 1*b*, together form a side elevation, with portions broken away, of the fixed cable restraint system of the present invention.

Turning now to the drawings, there is shown in FIG. 1 a safety cable restraint system 10 extending along a rail 11 of a railroad track, indicated generally at 12. Although not shown, it will be understood that the railroad track 12 may be supported by a rail bridge or track tressel and that the safety cable restraint system 10 has particular utility in such circumstances. Indeed, as shown in FIG. 1, several individuals 15, who may be railroad inspectors or track maintenance workers, are standing on the track roadbed outboard one of the rails 11. It will also be understood that each of the inspectors or workers 15 wears a safety harness, only generally indicated at 16, with an attached safety line or fall arrest system 17 which may be slidably secured to the safety cable restraint system 10 of the present invention.

In accordance with the present invention, the safety cable restraint system 10 includes an elongated cable 20 secured at each end by an end anchor mechanism 22 to the rail 11. The cable 20 is supported between its ends by a plurality of intermediate support arms or stanchions 32 so that the cable is held above and outboard of the rail 11. As shown in FIG. 1, each of the workers 15 has his safety line or fall arrest system 17 slidably attached to the safety cable 20 by a suitable safety hook or clasp 18. Thus, the workers 15 are free to move or walk along the track rail 11 and the clasp 18 attached to their safety line 17 slides along the elongated cable 20 stretched along the track 12 above and outboard of the rail 11. In the event the worker 15 should slip and fall off the rail bridge or track tressel, his fall is quickly stopped or arrested by his body harness 16, safety line 17 and the safety restraint cable 20.

Figure 2:
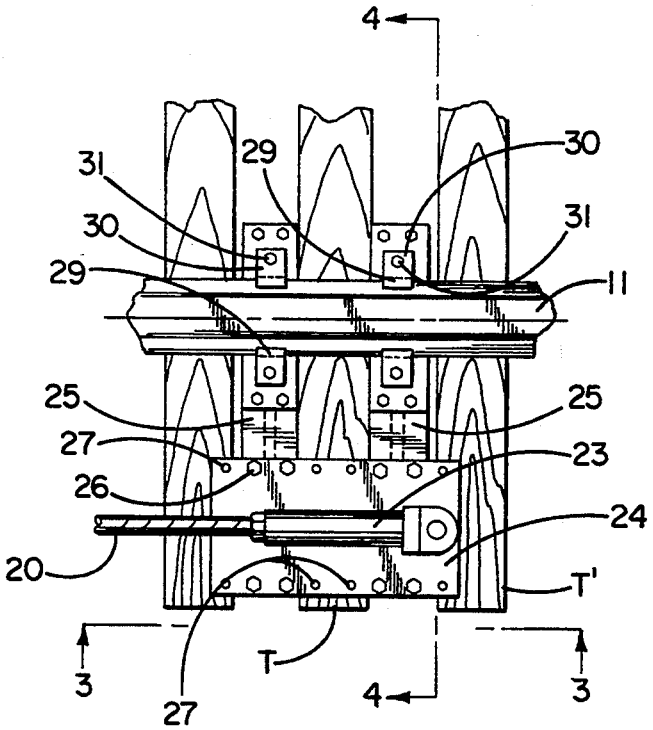
FIG. 2 is an enlarged, fragmentary plan view of one of the end anchors for the cable restraint system, substantially as seen along line 2—2 in FIG. 1.
Figure 3:
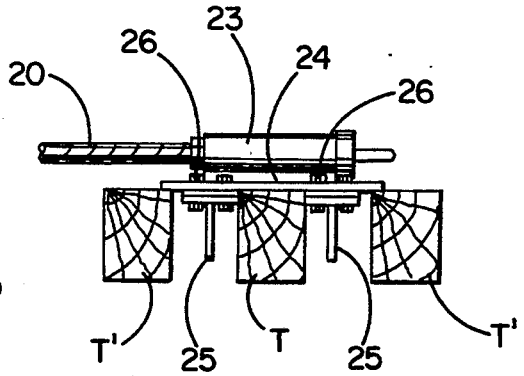
FIG. 3 is a side elevation of the end anchor of FIG. 2, substantially as seen along line 3—3.
Figure 4:
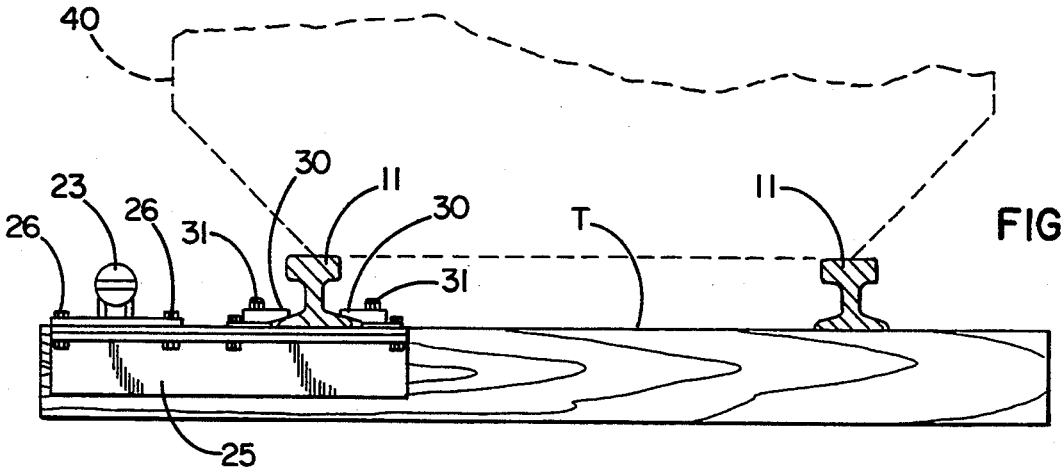
FIG. 4 is an end view, partially in section, of the end anchor of FIG. 2, substantially as seen along line 4—4.

Pursuant to the invention, the cable restraint system 10 may be quickly, conveniently and securely attached to one of the track rails 11. As shown in FIGS. 2–4, each of the end anchor mechanisms 22 includes an adjustable tensioning device such as a turnbuckle, spring or shock absorber 23 secured to a base plate 24 which, in turn, is clamped to the rail 11 by one or more laterally extending legs 25 which hold the base plate 24, the anchor device 23 and thus the end of the restraint cable 20 laterally outboard of the rail 11 (See FIGS. 2 and 4). As shown in FIG. 4, the safety restraint cable 20 and anchor device 23 are disposed laterally outboard of the rail 11 on one side of the track 12.

In the preferred embodiment,-illustrated in FIGS. 2–4, the anchor mechanism includes a pair of anchor legs 25 and the base plate 24 is secured to their outer ends by suitable means such as machine bolts, cap screws or the like 26. Preferably, the base plate is provided with a plurality of bolt holes 27 which permit the anchor legs 25 to be adjustably spaced apart. The turnbuckle or shock absorber 23 is similarly attached to the upper surface of the base plate 24. Alternatively, the fixed portion of the anchor device 23 may be welded to the base plate 24 and the base plate may be welded to the legs 25, however, this diminishes the versatility of the anchor mechanism 22.

To clamp the anchor mechanism 22 to the rail 11, the inboard end of each of the anchor legs 25 carries a pair of retaining clips 30 which are secured to the legs 25 by suitable machine bolts or cap screws 31 so as to clamp the base flanges of the rail 11 between the retaining clips 30 and the upper surface of the anchor legs 25. In the preferred embodiment, the retaining clips 30 are formed with an eccentric shape or an angled inner edge 29 so that they may be turned to accommodate rails having differing base widths and thicknesses.

To support the restraining cable 20 between the end anchor mechanisms 22, the intermediate supports 32 are likewise clamped to the rail so as to hold the cable 20 above and outboard of the rail 11. As shown in FIGS. 5–7 the intermediate support 32 comprises an upwardly and outwardly inclined support arm or stanchion 33 secured to a base plate 34 which, in turn, is clamped to the rail 11 in a manner similar to the anchor mechanism 22. Thus, in the preferred embodiment, the support arm 33 is bolted to the base plate and the base plate, in turn, is bolted to the outboard ends of a pair of support legs 35. The base plate preferably has a plurality of bolt holes which permit adjusting the spacing of the support legs secured thereto. It will be understood that this adjustable feature allows spacing the support 35 apart from one another so as to fit along the sides of one rail tie T and in the spaces between the two adjacent ties T'.

To clamp the intermediate support arm 32 to the rail 11, the inboard end of each of the support 35 carries a pair of retaining clip 36 which are secured to the legs 35 by bolts or screws similar to the bolts or screws 31 used to clamp the anchor mechanism 22 to the rail 11. Preferably the retaining clips 36 are also formed with an eccentric shape or an angled inner edge so that they may be turned to accommodate rails having different base widths and thicknesses.

In order to hold and guide the cable 20 above and outboard of the rail 11, the upper end of each of the support arms 32 is provided with a guide opening 37. As shown in FIG. 4 the end of the cable 20 is anchored outboard of the rail 11 and just above the level of the track ties T. The intermediate portion of the cable 20, however, is held by the-intermediate support arms 33 so that the cable is not only outboard of the rail 11, but also is located substantially above the level of the rail 11 and track ties T. Thus, as shown in FIG. 7, the upwardly angled intermediate support arms 33 hold the restraining cable well outside the envelope occupied by a moving train as indicated here generally by the broken line 40.

From the foregoing, it will be understood that the present invention provides a novel safety restraint system including a safety restraint cable 20, end anchor devices 22 and intermediate cable supports 32 that may be quickly, conveniently and securely attached to railroad rails passing over rail bridges or the like and to which railroad personnel can clamp the safety hook of their safety line attached to their safety harness. Thus, in the event a track inspector or rail maintenance worker should slip and fall from the bridge, his fall is promptly stopped or arrested by his personnel safety harness being secured to the safety restraint cable anchored directly to the rail 11 on the bridge.

We claim as our invention:

1. A safety cable restraint system for a railroad bridge supporting a railroad track having a pair of rails each having longitudinally extending, oppositely projecting, base flanges adapted to be supported on rail ties of different sizes and spacings, said safety cable restraint system comprising, in combination, an elongated safety cable having opposite ends, an anchor mechanism secured to each end of said cable, said anchor mechanism including a cable tensioning device, a pair of anchor legs each having an inner end clampable to one of said track rails and means for securing said tensioning device to the other ends of said anchor legs laterally offset from and outboard of said rail, said means for securing said tensioning device to said other ends of said anchor legs including means for adjusting the spacing between said anchor legs in order to fit around and between said rail ties of different sizes and spacings, and a plurality of intermediate supports for guiding and holding said cable above and laterally outboard of said rail between said anchor mechanisms, each of said intermediate supports including an upwardly projecting support arm, a support leg having an inner end clampable to said rail and means for securing said support arm to the other end of said support leg.

2. A safety restraint system as defined in claim 1 wherein said clampable anchor legs each include a pair of opposed retaining clips for securing the inner ends of said anchor legs to said base flanges of said rail.

3. A safety restraint system as defined in claim 2 wherein said retaining clips are adjustably mounted on said anchor legs in order to accommodate rails having base flanges of different widths.

4. A safety restraint system as defined in claim 3 wherein said retaining clips are adjustably mounted on said anchor and support legs in order to accommodate rails having base flanges of different widths.

5. A safety restraint system as defined in claim 1 wherein each of said intermediate supports include a pair of support legs and said means for securing said supports to said other ends of said support legs includes means for adjusting the spacing between said support legs in order to fit around and between said rail ties of different sizes and spacings.

6. A safety restraint system as defined in claim 5 wherein said clampable anchor and support legs each include a pair of opposed retaining clips for securing the inner ends of said anchor and support legs to said base flanges of said rail.

7. A safety restraint system as defined in claim 6 wherein said retaining clips are adjustably mounted on said anchor and support legs in order to accommodate rails having base flanges of different widths.

8. A safety cable restraint system for a railroad bridge supporting a railroad track having a pair of rails each having longitudinally extending, oppositely projecting, base flanges adapted to be supported on rail ties of different sizes and spacings, said safety cable restraint system comprising, in combination, an elongated safety cable having opposite ends, an anchor mechanism secured to each end of said cable, said anchor mechanism including a cable tensioning device, an anchor leg having an inner end clampable to one of said track rails and means for securing said tensioning device to the other end of said anchor leg laterally offset from and outboard of said rail, and a plurality of intermediate supports for guiding and holding said cable above and laterally outboard of said rail between said anchor mechanisms, each of said intermediate supports including an upwardly projecting support arm, a pair of support legs each having an inner end clampable to said rail, means for securing said support arm to the other ends of said support legs and means for adjusting the spacing between said support legs in order to fit around and between said rail ties of different sizes and spacings.

9. A safety restraint system as defined in claim 8 wherein said clampable anchor and support legs each include a pair of opposed retaining clips for securing the inner ends of said anchor and support legs to said base flanges of said rail.

* * * * *